US012065777B2

(12) United States Patent
Kanbargi et al.

(10) Patent No.: US 12,065,777 B2
(45) Date of Patent: Aug. 20, 2024

(54) METHODS FOR MODIFICATION OF ARAMID FIBERS

(71) Applicants: University of Massachusetts Amherst, Amherst, MA (US); Bridgestone Corporation, Chuo-ku (JP)

(72) Inventors: Nihal Kanbargi, Amherst, MA (US); Alan J. Lesser, Shutesbury, MA (US); Wei Zhao, Guangzhou (CN); Sheel P. Agarwal, Solon, OH (US); Mindaugas Rackaitis, Hudson, OH (US)

( * ) Notice: Subject to any disclaimer, the term of this patent is extended or adjusted under 35 U.S.C. 154(b) by 262 days.

(21) Appl. No.: 16/989,146

(22) Filed: Aug. 10, 2020

(65) Prior Publication Data

US 2020/0370237 A1 Nov. 26, 2020

Related U.S. Application Data

(62) Division of application No. 15/752,955, filed as application No. PCT/US2016/047539 on Aug. 18, 2016, now Pat. No. 10,738,418.

(60) Provisional application No. 62/316,000, filed on Mar. 31, 2016, provisional application No. 62/206,611, filed on Aug. 18, 2015.

(51) Int. Cl.

| | |
|---|---|
| ***D06M 13/07*** | (2006.01) |
| ***D02G 3/48*** | (2006.01) |
| ***D02J 1/22*** | (2006.01) |
| ***D02J 3/00*** | (2006.01) |
| ***D02J 3/08*** | (2006.01) |
| ***D06M 10/00*** | (2006.01) |
| ***D06M 10/06*** | (2006.01) |
| *D06B 3/06* | (2006.01) |
| *D06M 23/10* | (2006.01) |
| *D06M 101/36* | (2006.01) |

(52) U.S. Cl.

CPC ..... *D06M 13/07* (2013.01); *D02G 3/48* (2013.01); *D02J 1/22* (2013.01); *D02J 3/00* (2013.01); *D02J 3/08* (2013.01); *D06M 10/003* (2013.01); *D06M 10/06* (2013.01); *D06B 3/06* (2013.01); *D06M 23/105* (2013.01); *D06M 2101/36* (2013.01); *D10B 2331/021* (2013.01); *D10B 2505/022* (2013.01)

(58) Field of Classification Search

CPC ..... C08L 2205/16; C08L 2312/00; C09J 151/003; D06M 13/07; D06M 10/003

See application file for complete search history.

(56) References Cited

U.S. PATENT DOCUMENTS

| | | | | |
|---|---|---|---|---|
| 4,410,586 | A | 10/1983 | Ladizesky et al. | |
| 4,469,748 | A | 9/1984 | Sharma | |
| 4,680,228 | A | 7/1987 | Sharma | |
| 4,871,004 | A | 10/1989 | Brown et al. | |
| 5,175,239 | A * | 12/1992 | Gauntt | D01F 6/605 264/210.8 |
| 5,667,743 | A * | 9/1997 | Tai | D01F 6/605 264/210.4 |
| 5,922,161 | A | 7/1999 | Wu et al. | |
| 6,255,379 | B1 | 7/2001 | Hahn et al. | |
| 6,875,509 | B2 | 4/2005 | Ando | |
| 7,550,529 | B2 | 6/2009 | Drzal et al. | |
| 7,891,394 | B2 | 2/2011 | Zanzig et al. | |
| 8,501,837 | B2 | 8/2013 | Zhao et al. | |
| 2007/0111000 | A1* | 5/2007 | Ke | D02G 3/443 428/373 |
| 2009/0054620 | A1* | 2/2009 | Takiue | D01F 6/605 264/178 F |
| 2014/0223879 | A1* | 8/2014 | Lee | D06M 15/41 57/241 |
| 2015/0197876 | A1 | 7/2015 | Teasley | |

FOREIGN PATENT DOCUMENTS

| | | | |
|---|---|---|---|
| CN | 1041458 | A | 4/1990 |
| CN | 1340117 | A | 3/2002 |
| CN | 102947496 | A | 2/2013 |
| CN | 103225210 | A | 7/2013 |
| CN | 103261290 | A | 8/2013 |
| CN | 103469573 | A | 12/2013 |
| CN | 103842567 | A | 6/2014 |
| CN | 103938458 | A | 7/2014 |
| CN | 104769834 | | 7/2014 |
| CN | 104264232 | A | 1/2015 |
| EP | 0172057 | A1 | 2/1986 |

(Continued)

OTHER PUBLICATIONS

Morgan et al (The Relationship between the Physical Structure and the Microscopic Deformation and Failure Processes of Poly ( p-Phenylene Terephthalamide) Fibers, Journal of Polymer Science: Polymer Physics Edition, vol. 21, 1757-1783 (1983), published on Oct. 1983.*

Cheng et al.; Mechanical Properties of Kevlar KM2 Singe Fiber; Journal of Engineering Materials and Technology; Apr. 2005; vol. 127; https://materialstechnology.asmedigitalcollection.asme.org.

Greenwood, et al.; Compressive behavior of Kevlar 49 fibres and composites; Journal of Materials Science, 1974, vol. 9, pp. 1809-1814.

Tanner, et al.; The Kevlar Story—an Advanced Materials Case Study; Angew. Chem. Int. Ed. Engl. Adv. Mater.; 1989; vol. 28, No. 5.

(Continued)

*Primary Examiner* — Gregory Listvoyb

(74) *Attorney, Agent, or Firm* — Meredith E. Hooker; J. Gregory Chrisman

(57) ABSTRACT

Methods are described for treatment of aramid fibers to modify the surface of the fibers. The treated fibers have improved adhesion to elastomer materials as compared to untreated fibers. Modification methods include irradiating the fibers, compressing and straining the fibers under a constant pull force and immersing the fibers in a coupling agent fluid. The treated fibers can be used with elastomers and provide reinforcement elements in products such as tires.

20 Claims, 6 Drawing Sheets

(56) References Cited

FOREIGN PATENT DOCUMENTS

| | | | |
|---|---|---|---|
| EP | 0235988 | A1 | 9/1987 |
| GB | 2053026 | A | 2/1981 |
| JP | H0708518 | A | 1/1995 |
| JP | 2001303456 | A | 10/2001 |
| JP | 2002129467 | A | 5/2002 |
| JP | 2006152533 | A | 6/2006 |
| JP | 2013096019 | A | 5/2013 |
| JP | 2013528718 | A | 7/2013 |
| TW | 201520386 | A | 6/2015 |
| WO | 2003050345 | A3 | 6/2003 |
| WO | 2015108840 | A1 | 7/2015 |

OTHER PUBLICATIONS

Dobb, et al.; Microvoids in aramid-type fibrous polymers; Polymer, 1979, vol. 20.

Herrera-Franco, et al.; Comparison of methods for the measurement of fibre/matrix adhesion in composites; Composites, 1992, vol. 23, No. 1.

G.M. Wu; Oxygen plasma treatment of high performance fibers for composites; Materials Chemistry and Physics, 2004, vol. 85, pp. 81-87.

Dobb,et al.; Supramolecular Structure of a High-Modulus Polyaromatic Fiber (Kevlar 49); Journal of Polymer Science, 1977, vol. 15, pp. 2201-2211.

Jeng-Shyong Lin; Effect of surface modification by bromination and metalation on Kevlar fibre-epoxy adhesion; European Polymer Journal, 2002, vol. 38, pp. 79-86.

The European Search Report issued in corresponding European Application No. 16837830.5; Mailing Date: May 29, 2019.

* cited by examiner

METHODS FOR MODIFICATION OF ARAMID FIBERS

This application is a divisional of U.S. application Ser. No. 15/752,955, filed Feb. 15, 2018 and assigned U.S. Pat. No. 10,738,418, which is a national stage of PCT/US16/47539 filed Aug. 18, 2016, which claims the benefit of U.S. Provisional Application Ser. No. 62/206,611 filed Aug. 18, 2015, and U.S. Provisional Application Ser. No. 62/316,000 filed Mar. 31, 2016, the contents of which are incorporated herein in their entirety by reference.

TECHNICAL FIELD

The present disclosure relates to methods for modifying the surface of aramid fibers to improve roughness and adhesion to elastomer materials, for example, rubber-containing compositions. The disclosure also relates to the use of the surface-enhanced aramid fibers in producing vulcanized products, for example, tires and belts.

BACKGROUND

Fibers are commonly used as reinforcement elements to increase strength and durability of various elastomer materials and related products, for example, rubber tires or belts. Aramid fibers, such as Kevlar fibers, can exhibit poor adhesion to elastomers due to their high crystallinity and smooth outer surface. The surface of the fibers also can be chemically inert further reducing adhesion to other materials. The lack of adequate adhesion at the elastomer and reinforcement matrix interface often results in poor material performance and can limit potential applications of the elastomer materials.

Surface modification and treatment of fibers has been attempted to improve adhesion to elastomer materials. For instance, plasma treatment can increase rubber adhesion by increasing activation energy at the surface of the fibers or etching the fiber surface to increase its roughness. Other methods of promoting adhesion include using coatings or adhesives that are regularly applied to aramid cords to form outer surfaces that are more compatible with materials encapsulating the fibers. Adhesive systems can include multiple steps and require introduction of new materials to rubber products or fibers, both of which can increase time and cost associated with the manufacture of the products.

It is an objective of the present disclosure to alleviate or overcome one or more difficulties related to the prior art. It has been found that treatments of aramid fibers involving acid, microwave, mechanical bending, coupling agent contact and combinations thereof can beneficially modify the surface of aramid fibers and can increase the adhesion of the fiber surface to elastomer materials.

SUMMARY

In a first aspect, there is a method for modifying the surface of an aramid fiber. The method includes (a) contacting the aramid fiber with an acid solution for a pre-determined amount of time to form a pre-treated aramid fiber; (b) removing the aramid fiber of step (a) from the acid solution and immersing the pre-treated aramid fiber in a liquid; (c) irradiating the pre-treated aramid fiber in the liquid to modify the surface of the aramid fiber; and (d) removing the aramid fiber form the liquid.

In an example of aspect 1, the aramid fiber is poly (paraphenylene terephthalamide).

In another example of aspect 1, the aramid fiber is poly(metaphenylene isophthalamide).

In another example of aspect 1, the acid is selected from the group consisting of hydrochloric acid, nitric acid, sulfuric acid, hydrobromic acid, phosphoric acid, hydroiodic acid, perchloric acid and combinations thereof.

In another example of aspect 1, the aramid fiber is immersed in the acid solution, for instance, for a period of at least 20 minutes.

In another example of aspect 1, the liquid of step (b) is water, for instance deionized water (DI water).

In another example of aspect 1, the irradiating step (c) is carried out in a vessel, for instance, a microwave to subject the fibers to microwave energy.

In another example of aspect 1, step (c) includes irradiating the pre-treated aramid fiber for a period of at least 15 seconds.

In another example of aspect 1, step (c) includes irradiating the pre-treated aramid fiber at a power level of at least 60 Watts.

In another example of aspect 1, there is an aramid fiber having enhanced adhesion to elastomer, the aramid fiber being prepared by the method of claim 1.

The first aspect may be provided alone or in combination with any one or more of the examples of the first aspect discussed above.

In a second aspect, the aramid fiber of aspect 1, for example, the aramid fiber of step (d), is brought in contact with a coupling agent.

In an example of aspect 2, the coupling agent is a vinyl-substituted compound, for example a cyclic compound having two or more vinyl groups, or a cyclic compound having a branched alkyl substituent.

In another example of aspect 2, the coupling agent is a vinyl-substituted silicone, e.g., low molecular weight silicone having a molecular weight ($M_W$) of less than 1000.

In another example of aspect 2, the coupling agent is mixed with a solvent, for instance, an organic solvent or supercritical carbon dioxide.

In another example of aspect 2, the aramid fiber of step (c) is immersed in a coupling agent fluid for at least 30 minutes.

In another example of aspect 2, the aramid fiber has an adhesion greater than 0.8 MPa to a rubber composition, according to TEST #1.

The second aspect may be provided alone or in combination with any one or more of the examples of the first or second aspects discussed above.

In a third aspect, there is an aramid fiber having enhanced adhesion to elastomer material, the aramid fiber is prepared by immersing the aramid fiber in liquid and irradiating the aramid fiber to modify its surface.

In an example of aspect 3, the surface of the aramid fiber is modified by the formation of blisters on the surface, the blisters extending outward from the surface of the aramid fiber as compared to the blister free aramid fiber surface prior to the irradiating step.

In another example of aspect 3, the aramid fiber being poly(paraphenylene terephthalamide) or poly(metaphenylene isophthalamide).

In another example of aspect 3, the aramid fiber is irradiated in a microwave vessel for a period of at least 30 seconds at a power of at least 60 Watts.

The third aspect may be provided alone or in combination with any one or more of the examples of the third aspect discussed above.

In a fourth aspect, there is a method for modifying the surface of an aramid fiber. The method includes (a) subjecting the aramid fiber to a tensile force; (b) bending the aramid fiber at an angle of greater than 30 degrees; and (c) releasing the aramid fiber from the tensile force.

In an example of aspect 4, the aramid fiber is poly (paraphenylene terephthalamide) or poly(metaphenylene isophthalamide).

In another example of aspect 4, the tensile force applied to the aramid fiber of step (a) is at least 0.5 N.

In another example of aspect 4, step (b) includes bending the aramid fiber at an angle in the range of 45 to 150 degrees.

In another example of aspect 4, includes bending the aramid fiber two or more times at an angle of at least 30 degrees.

In another example of aspect 4, step (b) includes bending the aramid fiber two or more times at an angle of at least 90 degrees.

In another example of aspect 4, step (b) is carried out in a continuous process by passing the aramid fiber over an element to apply the bending of the aramid fiber.

In another example of aspect 4, the element is a roller or a static cylinder having a curved surface.

In another example of aspect 4, the aramid fiber is twisted at a twist rate in the range of 10 to 200 turns per meter after step (c).

The fourth aspect may be provided alone or in combination with any one or more of the examples of the fourth aspect discussed above.

In a fifth aspect, the aramid fiber of aspect 4, for example, the aramid fiber of step (c), is brought in contact with a coupling agent.

In an example of aspect 5, the coupling agent is a vinyl-substituted compound, for example a cyclic compound having two or more vinyl groups, or a cyclic compound having a branched alkyl substituent.

In another example of aspect 5, the coupling agent is vinyl-substituted silicone compound, e.g., low molecular weight silicone having a molecular weight ($M_W$) of less than 1000.

In another example of aspect 5, the coupling agent is mixed with a solvent, for instance, an organic solvent or supercritical carbon dioxide.

In another example of aspect 5, the aramid fiber of step (c) is immersed in a coupling agent fluid for at least 30 minutes.

In another example of aspect 5, the aramid fiber has an adhesion greater than 0.8 MPa to a rubber composition, according to TEST #1.

The fifth aspect may be provided alone or in combination with any one or more of the examples of the fourth or fifth aspects discussed above.

In a sixth aspect, there is an aramid fiber having enhanced adhesion to elastomer material, the aramid fiber is prepared by bending the aramid fiber at an angle of greater than 30 degrees under a constant tensile force being applied to the aramid fiber.

In an example of the sixth aspect, the aramid fiber is poly(paraphenylene terephthalamide) or poly(metaphenylene isophthalamide).

In a seventh aspect, there is a method of improving adhesion of an aramid fiber to an elastomer material. The method includes (a) contacting the aramid fiber with a coupling agent fluid; (b) removing the aramid fiber from the fluid; and (c) drying the aramid fiber.

In an example of the seventh aspect, the aramid fiber is poly(paraphenylene terephthalamide) or poly(metaphenylene isophthalamide).

In another example of the seventh aspect, the coupling agent is a vinyl-substituted compound, for example a cyclic compound having two or more vinyl groups, or a cyclic compound having a branched alkyl substituent.

In another example of the seventh aspect, the coupling agent is a vinyl-substituted silicone, e.g., low molecular weight silicone having a molecular weight ($M_W$) of less than 1000.

In another example of the seventh aspect, the coupling agent fluid of step (a) being the coupling agent mixed with a solvent, for instance, an organic solvent or supercritical carbon dioxide.

In another example of the seventh aspect, the aramid fiber has an adhesion greater than 0.8 MPa to a rubber composition, according to TEST #1.

In another example of the seventh aspect, the aramid fiber is in contact with an acid solution prior to step (a).

In another example of the seventh aspect, the aramid fiber is irradiated in a liquid prior to step (a).

In another example of the seventh aspect, the aramid fiber is bent at an angle of greater than 30 degrees under a constant tensile force being applied to the aramid fiber prior to step (a).

The seventh aspect may be provided alone or in combination with any one or more of the examples of the seventh aspect discussed above.

In an eighth aspect, there is an aramid fiber having enhanced adhesion to elastomer material, the aramid fiber is prepared by contacting the aramid fiber with a coupling agent fluid for at least 30 minutes.

In an example of aspect 8, the aramid fiber is poly (paraphenylene terephthalamide) or poly(metaphenylene isophthalamide).

In another example of aspect 8, the coupling agent is a vinyl-substituted compound, for example a cyclic compound having two or more vinyl groups, or a cyclic compound having a branched alkyl substituent, or a vinyl-substituted silicone, e.g., low molecular weight silicone having a molecular weight ($M_W$) of less than 1000 or a combination thereof.

The accompanying drawings are included to provide a further understanding of principles of the invention, and are incorporated in and constitute a part of this specification. The drawings illustrate one or more embodiment(s), and together with the description serve to explain, by way of example, principles and operation of the invention. It is to be understood that various features disclosed in this specification and in the drawings can be used in any and all combinations. By way of non-limiting example the various features may be combined with one another as set forth in the specification as aspects.

BRIEF DESCRIPTION OF THE DRAWINGS

The above description and other features, aspects and advantages are better understood when the following detailed description is read with reference to the accompanying drawings, in which.

DETAILED DESCRIPTION

Figure 1:
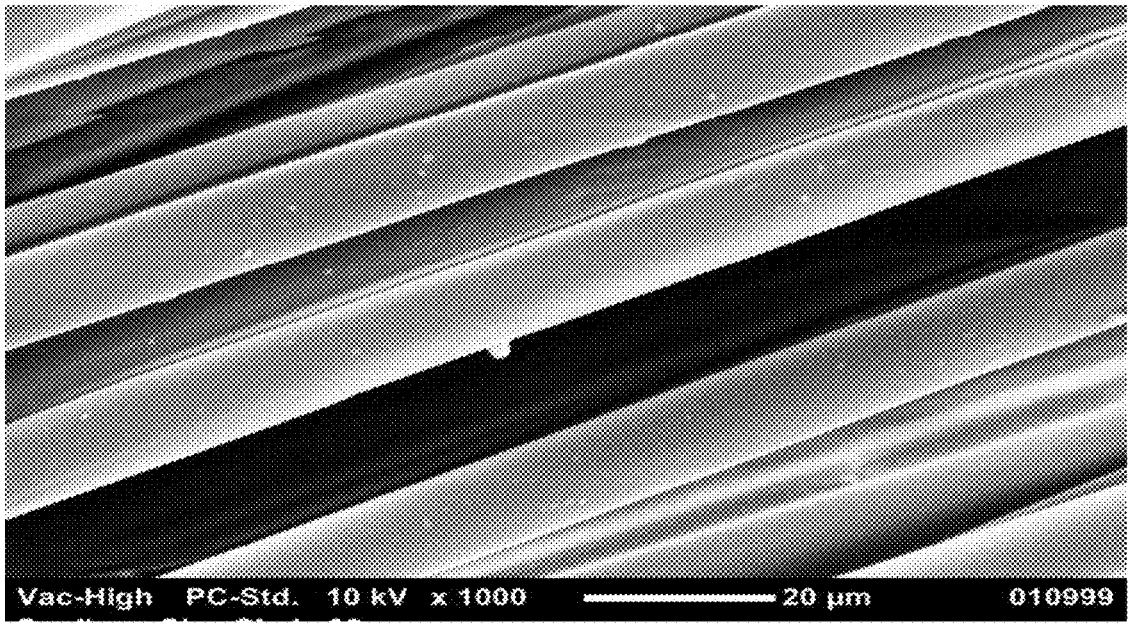
FIG. 1 shows a scanning electron microscope image of untreated poly(paraphenylene terephthal amide) fibers.

The terminology as set forth herein is for description of the embodiments only and should not be construed as limiting the invention as a whole.

Herein, when a range such as 5-25 (or 5 to 25) is given, this means preferably at least or more than 5 and, separately and independently, preferably not more than or less than 25. In an example, such a range defines independently at least 5, and separately and independently, not more than 25.

As used herein, the term "phr" means the parts by weight of rubber. If the rubber composition comprises more than one rubber, "phr" means the parts by weight per hundred parts of the sum of all rubbers.

The present disclosure relates to the adhesion of aramid fibers to elastomer compositions, for example, rubber compositions or vulcanizable composition conventionally used to manufacture tires or belts. Aramid fibers can be in the form of a reinforcing element, for example, as yarns, filaments, fibers, cords, fabric or combinations thereof. One example of an aramid fiber is KEVLAR®, which is a highly crystalline material with excellent tensile properties due to hydrogen bonding between the chains. The method of preparing these fibers leads to a highly anisotropic structure in which sheets of lamellae spread radially outward from the center. Because of its high crystallinity, the surface of the fiber is very smooth. It has been found that the internal components of aramid fibers can be opened up to expose the amorphous content and agents that bond with elastomer materials can be inserted or penetrated into the fibers to generate better adhesion and improve the overall mechanical properties of the elastomer product having one or more aramid fibers retained therein.

To expose portions of the aramid fiber below its surface, treatment of the aramid fibers can be carried out. Aramid fibers can have microvoids, which are capable of mass uptake. These voids can be a target to introduce adhesion promoters, for example, coupling agents. In this disclosure, treatments to provide roughness to the aramid fiber surface and/or open up the voids to make them more accessible are described. Introduction of coupling agents or crosslinkable monomers into the opened internal portion of the fibers can be carried after surface treatment of the fibers to enhance adhesion of the fibers to an elastomer material.

As described herein, aramid fibers are fibers of polymers that are partially, preponderantly or exclusively composed of aromatic rings, which are connected through amide bridges or optionally, in addition also through other bridging structures. The structure of such aramids can be elucidated by the following general formula of repeating units:

$$(\text{—NH-A}_1\text{-NH—CO-A}_2\text{-CO—})_n$$

wherein $A_1$ and $A_2$ are the same or different aromatic and/or polyaromatic and/or heteroaromatic rings, that can also be substituted. For example, the amide (—CO—NH—) linkages are attached directly to two aromatic rings. In one embodiment, at least 85% of the amide (—CONH—) linkages are attached directly to two aromatic rings. $A_1$ and $A_2$ can each independently be selected from 1,4-phenylene, 1,3-phenylene, 1,2-phenylene, 4,4'-biphenylene, 2,6-naphthylene, 1,5-naphthylene, 1,4-naphthylene, phenoxyphenyl-4,4'-diylene, phenoxyphenyl-3,4'-diylene, 2,5-pyridylene and 2,6-quinolylene which may or may not be substituted by one or more substituents which may include halogen, $C_1$-$C_4$-alkyl, phenyl, carboalkoxy, $C_1$-$C_4$-alkoxyl, acyloxy, nitro, dialkylamino, thioalkyl, carboxyl and sulfonyl. The (—CO—NH—) group may also be replaced by a carbonyl-hydrazide (—CONHNH—) group, azo- or azoxy-group.

Additives can be used with the aramid, for example, up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride of the aramid.

Suitable aramid fibers are described in Man-Made Fibers—Science and Technology, Volume 2, Section titled Fiber-Forming, Aromatic Polyamides, page 297, W. Black et al., Interscience Publishers, 1968. M-aramid are those aramids where the amide linkages are in the meta-position relative to each other, and p-aramids are those aramids where the amide linkages are in the para-position relative to each other. In the practice of this disclosure the aramids most often used are poly(paraphenylene terephthalamide) (e.g., KEVLAR®) and poly(metaphenylene isophthalamide) (e.g., NOMEX®).

A method of modifying the surface of the aramid fibers can include contacting the aramid fibers with an acid, for example, with an acid solution as an acid treatment. The acid can be any suitable acid. For example, inorganic or strong acids can be used to treat the aramid fibers. Acids can include, for example, hydrochloric acid (HCl), nitric acid ($HNO_3$), sulfuric acid ($H_2SO_4$), hydrobromic acid (HBr), hydroiodic acid (HI), perchloric acid ($HClO_4$, $HClO_3$) or any combination thereof. Other acids can include phosphoric acid, chromic acid, carbonic acid, ascorbic acid, acetic acid, citric acid, fumaric acid, maleic acid, tartaric acid, succinic acid, glycolic acid or any combination thereof.

The acid can be in solution, for example, an aqueous solution. The acid solution can have any suitable concentration of acid, for example, the acid can be present in the solution in a concentration range of 1 to 99 weight percent, 5 to 90, 10 to 80, 15 to 60 or 20 to 50, or 25, 30, 35, 40 or 45 weight percent.

The aramid fibers can be brought into contact with the acid by any conventional means. For example, the fibers can be immersed or soaked in the acid solution for a predetermined period of time. The fibers can be contacted with the acid for a period of time in the range of 20 minutes to 2 days, 30 minutes to 24 hours, 45 minutes to 12 hours, or 1 hour, 2 hours, 4 hours or 6 hours. The fibers can be in contact with the acid at any suitable temperature, for example, at a temperature in the range of 20 to 140, 25 to 100, or 30, 40, 50, 60, 70, 80 or 90 degrees Celsius.

The acid treatment of the aramid fibers can be carried out as an individual treatment method before adhering the fibers to an elastomer material or, alternatively, the acid treatment can be combined with further treatments applied to the fibers, for instance, before adhesion to an elastomer.

In another method of modifying the surface of the aramid fibers, the fibers can be irradiated, for example, by exposing the fibers to microwaves or microwave energy. Irradiating the fibers with microwaves can be carried out at any frequency in the microwave region, for example, 300 MHz to 300 GHz. In one embodiment, a microwave vessel (e.g., oven) can be used to irradiate the aramid fibers. A microwave oven can irradiate the fibers at a frequency in the range of 1 to 4 GHz, 2 to 3 GHz or 2.4, 2.45 or 2.5 GHz. The microwave oven can be operated at any suitable power, for instance, at least 60 Watts. The power level of the microwave vessel can be in the range of 60 Watts to 2.5 KW, 75 Watts to 1 KW, 100 to 500 Watts, or 150 to 250 Watts.

This process can be done continuously by using a commercially available microwave system with conveyors. The process also can be carried out with a closed microwave system in a batch-type processing system. The fibers can be irradiated for any suitable time. For example, the aramid fibers can be irradiated for a time period in the range of 15 seconds to 10 minutes, 30 seconds to 5 minutes, 45 seconds to 3 minutes, or 1 minute or 2 minutes.

Irradiating the aramid fibers can cause liquid under the surface of the fibers to vaporize. Liquid in the fibers can be present after manufacture of the fibers (e.g., residual solvent) or be introduced by contacting the fibers to penetrating liquids, for example, an acid solution or solvent, alone or carrying one or more materials. The gas or vapor generated in the fibers during irradiation has the tendency to migrate towards the surface of the fibers to escape. Exposure of the fibers to irradiation energy, such as microwave energy, can generate blisters on the surface of the fibers. Blisters on the surface of an aramid fiber exposed to microwave energy can be seen in FIG. 4. The blisters extend radially outward from the surface of the fibers and provide a roughness to the surface of the fibers to enhance adhesion of other materials. As shown, the blisters rise above the surface of the fibers as compared to the smooth and blister free aramid fiber surface prior to irradiation (e.g., as shown in FIG. 1). The blisters on the surface of the aramid fiber can provide a textured surface for elastomeric material to adhere and the blisters can further form surfaces that entrap material at the fiber surface to enhance adhesion. In an example, the blisters can break and open as the aramid fibers come into contact with an elastomer material such that the material can fill voids created and exposed by the open blisters both on the surface of the fiber and under the surface. As a result, the material can become embedded in voids in the fibers and along the textured surface formed by the blisters.

The aramid fibers are preferably immersed in a liquid prior to irradiation. Any suitable liquid can be used, for example, water (e.g., deionized water). The aramid fibers can be degraded or damaged if heated for a prolonged period of time. By immersing the fibers in a liquid during irradiation, scorch or charring of the fibers can be prevented. The liquid can act as a heat sink to minimize a rise in temperature during irradiation. A vessel for irradiating the aramid fibers, for example a microwave vessel, can be equipped with temperature sensors. One or more temperature sensors can control the amount of irradiation energy that the fibers are exposed to in order to prevent the fibers from being exposed to elevated temperatures that can damage the fibers during treatment.

In one embodiment, the aramid fibers can be in contact with an acid solution to form pre-treated fibers. The fibers can be removed from the acid solution and immersed in another liquid, for example, water before being irradiated with microwave energy to further treat the aramid fibers. The fibers may be optionally dried after being removed from the acid solution.

In another method of modifying the surface of the aramid fibers, the fibers can be mechanically treated. The aramid fibers can be subjected to a constant tensile force or load. For example, the fibers can be placed in a tensile testing machine to apply a constant pulling load. The tensile force applied to the fibers can be in the range of 0.25 Newton (N) to 10 N, 0.5 to 5 N, 0.75 to 3 N, or 1 or 2 N. Compression and bending strains can be applied to the fibers under a constant tensile force. The compression force and bending strains can be applied in a continuous process by passing the fibers under tensile force over elements that subject the fibers to a bending angle, for example, a bending angle in the range of 30 to 150 degrees, 45 to 140 degrees, 60 to 130 degrees or 70, 80, 90, 100, 110 or 120 degrees.

Figure 5:
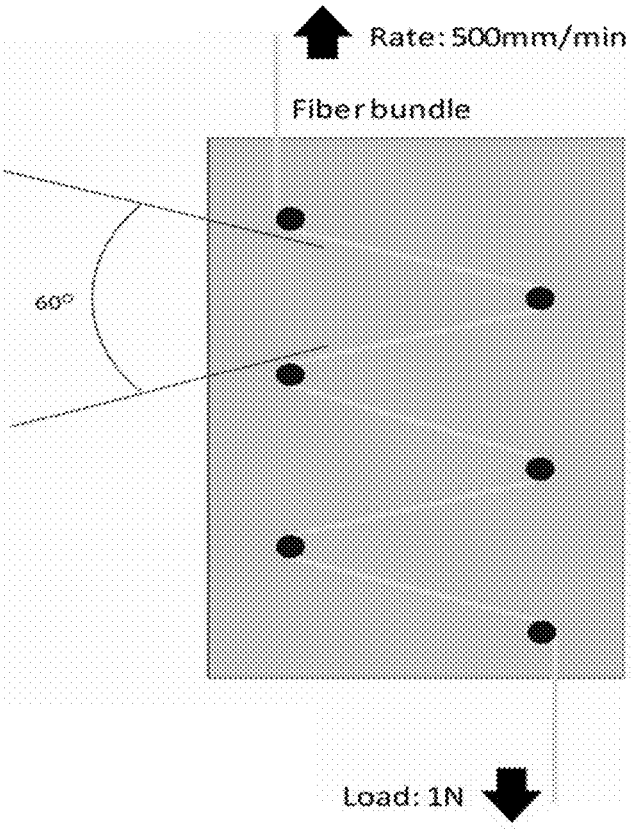
FIG. 5 shows a mechanical treatment device used to impose a uniform and consistent amount of compression and bending strain on poly(paraphenylene terephthalamide) fibers.

The aramid fibers can be subjected to one or more bends in a mechanical treatment, for example, the fibers can be bent two to twenty times. Each bend of the fibers can be at the same or different angles. In one embodiment, the fibers can be bent two or more times at a bending angle of at least 90, 100, 110 or 120 degrees. An example bending apparatus set up is shown in FIG. 5. As shown, an aramid fiber is subjected to six bends in a continuous manner, with four of the six bends being at 120 degrees.

The compression and bending strains can be applied to the aramid fibers by passing the fibers over an element that changes the path of a fiber at the desired bending angle. For example, the element can have a curvature, such as that of a roller or static cylinder having a curved face. A series of elements can be arranged and the fibers can be passed through or along the bending element arrangement to apply one or more bends at any desired being angle.

The above treatments, acid, irradiation and mechanical, modify the surface of the aramid fibers. The surface of the fibers can be altered to expose internal material of the fibers that resides below the outer surface. Prior to or after the above treatments, a coupling agent can be introduced to the fiber to promote adhesion to elastomer materials.

The aramid fibers can be contacted with one or more coupling agents. For example, coupling agents can be a liquid at room temperature or be heated to a melting point so the fibers can be immersed in the coupling agents for a period of time. The fibers can be in contact with the coupling agent for a period of time in the range of 20 minutes to 2 days, 30 minutes to 24 hours, 45 minutes to 12 hours, or 1 hour, 2 hours, 4 hours or 6 hours. The fibers can be in contact with the coupling agent at any suitable temperature, for example, at a temperature in the range of 20 to 140, 25 to 100, or 30, 40, 50, 60, 70, 80 or 90 degrees Celsius.

The coupling agents can be combined with other fluids, for example, a solvent, prior to contacting the fibers. The coupling agents can be present in the solvent or solvent system at any suitable concentration, for example, from 10 to 90 weight percent.

The solvent can be an organic solvent. A wide variety of organic solvents may be utilized in the organic solvent system, as discussed below. Suitable general solvent classes include, but are not limited to, $C_1$-$C_6$ alcohols, halogenated hydrocarbons, saturated hydrocarbons, aromatic hydrocarbons, ketones, ethers, alcohol ethers, nitrogen-containing heterocyclics, oxygen-containing heterocyclics, esters, amides, sulfoxides, carbonates, aldehydes, carboxylic acids, nitrites, nitrated hydrocarbons and acetamides.

The organic solvent can be in a solvent system, which can be a single solvent or a mixture of solvents. Generally, mixtures of solvents will contain at least two, and may contain as many as 5-10 solvents. The solvents include, but are not limited to, perchloroethylene, iso-octane (also called trimethylpentane), hexane, acetone, methylene chloride, toluene, methanol, chloroform, ethanol, tetrahydrofuran, acetonitrile, methyl ethyl ketone, pentane, N-methylpyrrolidone, cyclohexane, dimethyl formamide, xylene, ethyl acetate, chlorobenzene, methoxyethanol, morpholine, pyridine, piperidine, dimethylsulfoxide, ethoxyethanol, isopropanol, propylene carbonate, petroleum ether, diethyl ether, dioxane, and mixtures thereof.

In one embodiment, the solvent can be supercritical carbon dioxide. Carbon dioxide is desirable due to its ready availability, non-flammable and environmental safety (non-toxic). The critical temperature of carbon dioxide is 31° C. and the dense (or compressed) gas phase above the critical temperature and near (or above) the critical pressure is often referred to as a "supercritical fluid." In this state, carbon dioxide is dense as a fluid but also fills up a container like a gas. Supercritical carbon dioxide is an effective solvent for small molecules and a poor solvent for polymers, with the exceptions of some fluoropolymers and silicones. Thus, the density and solvent properties of supercritical carbon dioxide are used to transport small molecules into the microvoids close to the surface of the aramid fibers which can act as a coupling agent and bond and aid in crosslinking the matrix, for example, elastomer material or rubber.

In one embodiment, coupling agents useful for improving adhesion between the fibers and an elastomer material can include vinyl-substituted compounds having two, three, four or more vinyl substituents or groups. Vinyl-substituted compounds can include, for example, linear or cyclic compounds having two or more vinyl groups. Cyclic compounds can include $C_3$-$C_8$ cyclic structures or macrocyclic rings ($C_8$ or greater). The cyclic compounds can be monocyclic or be fused multi-ring compounds. Other cyclic compounds can be hetero cyclic compounds having two or more vinyl substituents, for example, cyclic rings having at least an oxygen or nitrogen atom. An example of a vinyl-substituted cyclic compound is divinyl benzene. Divinyl benzene can be provided by Sigma Aldrich.

In another embodiment, the coupling agents can include vinyl-substituted low molecular weight silicone or a combination thereof with other coupling agents disclosed herein. Low molecular weight silicone can include those having a molecular weight ($M_W$) of less than 1000, 750, 600, 500, 450, 400 or 350 grains per mole. The low molecular weight silicone can be substituted with two or more vinyl groups, for example, 3, 4 or more vinyl groups. In an example, the vinyl groups can be substituted on the Si atoms of the silicone compound.

In another embodiment, the coupling agent can be cyclic compound substituted with two or more alkyl groups. The alkyl groups can include alkyls having from 1 to 20 carbon atoms. The alkyl groups can be linear or branched, for example, di- and tri-alkyl groups. Cyclic compounds can include $C_3$-$C_8$ cyclic structures or macrocyclic rings ($C_8$ or greater). The cyclic compounds can be monocyclic or be fused multi-ring compounds. Other cyclic compounds can be hetero cyclic compounds having two or more vinyl substituents, for example, cyclic rings having at least an oxygen or nitrogen atom. Examples of cyclic compounds substituted with alkyl groups include 1,3-diisopropylbenzene and 1,4-diisopropylbenzene.

Figure 7:
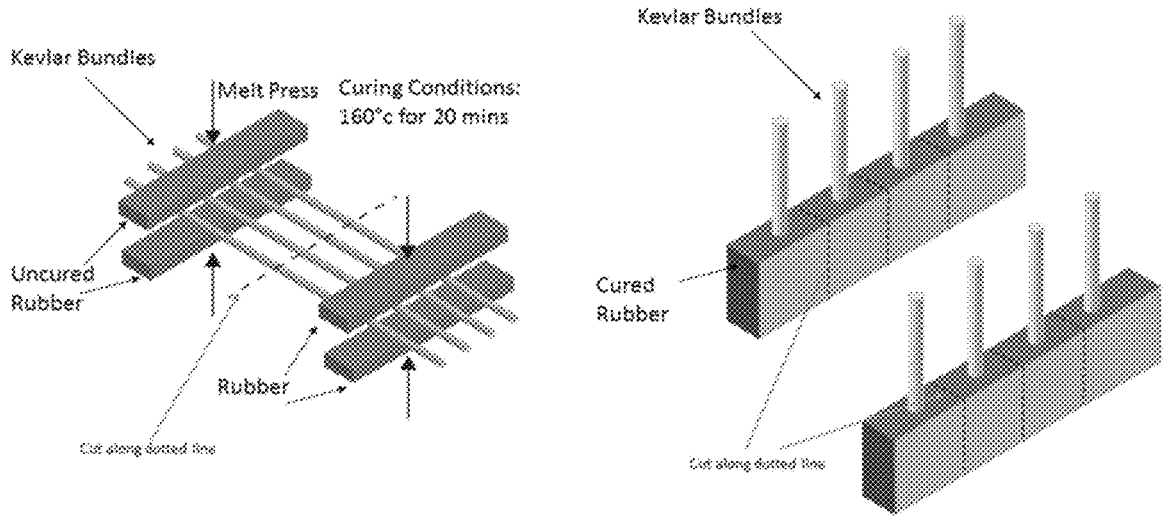
FIG. 7 is a schematic of a sample preparation method for an adhesion test to measure the adhesion of fibers to an elastomer material.
Figure 8:
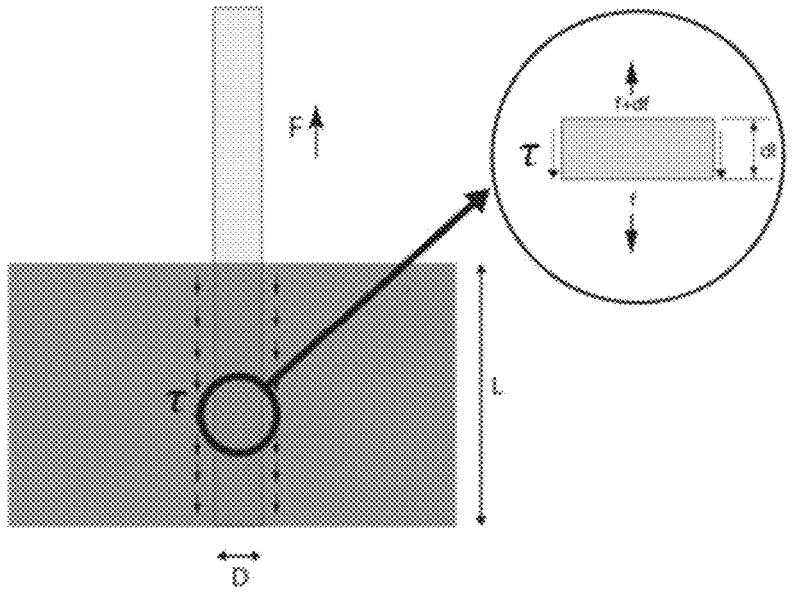
FIG. 8 is a schematic of a shear lag model for an adhesion test to measure the adhesion of fibers to an elastomer material.

The treated aramid fibers described herein can be subjected to adhesion testing to provide a quantitative measure of the adhesion between the fiber and the matrix. An example of a preferred adhesion test is described in Example 4 below and a schematic of the adhesion test is shown in FIGS. 7 and 8. The adhesion test optionally involves imparting a twist to the aramid fiber prior to embedding the fiber into an elastomer material, for example, 150 turns per meter. Fiber is sandwiched between two materials and heated to cure the materials and adhere them to the fiber. For example, the uncured materials and fiber can be placed in a melt press and heated for a period of time, e.g., 5 minutes to 1 hours, 10 to 50 minutes or 20, 30 or 40 minutes. Heating to a cure or bonding temperature can include raising the temperature of the materials to a temperature in the range of 50 to 250° C., 75 to 200° C., or 100, 125, 150, 160, 170, 180 or 190° C.

Aramid fibers embedded in elastomer material are sectioned into test samples having one or more aramid fibers extending outward from a block of elastomer material. The one or more aramid fibers or bundles are then pulled until failure, i.e. the fiber being completely pulled out from the elastomer material.

A basic shear lag model is used to calculate the adhesion between the fiber and elastomer material. The model assumes that the build-up of tensile stresses along the length of the fiber is caused entirely due to the shear forces that act on the cylindrical shape interface between the fiber and elastomer material. Considering a differential element as shown in FIG. 8, and doing a force balance on it yields equation (1):

$$\int df_{L0} = \pi D \int \tau dl_{L0} \quad (1)$$

Assuming constant stress throughout the length of the fiber embedded in the elastomer material, the shear stress (Pa or $N/m^2$) (i.e. the measure of adhesion) can be calculated by equation (2):

$$F \pi D L = \tau \quad (2)$$

wherein (F) is tensile force in Newtons (N), D is the diameter of the fiber or fiber bundle (meters) and L is the length of displacement of the fiber through the elastomer material (meters).

As shown in the examples herein, one or more treatment methods can be applied to the aramid fibers to improve adhesion of the fibers to elastomer materials. The treated aramid fibers can be used in various applications that benefit from such improved adhesion. For example, the aramid fibers can be used in rubber products such as tires (e.g., belt plies, body plies, beads, reinforcement elements), belts (e.g., conveyor) and reinforced air springs. The treated aramid fibers can be combined with vulcanizable compositions, for example, the fibers can be embedded in the compositions as a reinforcement element.

The vulcanizable rubber composition can be prepared by forming an initial masterbatch that includes the rubber component and filler. This initial masterbatch can be mixed at a starting temperature of from about 25° C. to about 125° C. with a discharge temperature of about 135° C. to about 180° C. To prevent premature vulcanization also known as scorch, this initial masterbatch may exclude any vulcanizing agents. Once the initial masterbatch is processed, the vulcanizing agents can be introduced and blended into the initial masterbatch at low temperatures in a final mix stage, which may not initiate the vulcanization process. Optionally, additional mixing stages, sometimes called re-mills, can be employed between the masterbatch mix stage and the final mix stage. Treated aramid fibers can be combined with the uncured composition, for example, the fibers can be extruded with the composition or sandwiched between layers of uncured material. Rubber compounding techniques and the additives employed therein are generally known as disclosed in The Compounding and Vulcanization of Rubber, in Rubber Technology ($2^{nd}$ Ed. 1973). The mixing conditions and procedures applicable to silica-filled tire formulations are also well known as described in U.S. Pat. Nos. 5,227,425, 5,719,207, 5,717,022, and European Pat. No. 890,606, all of which are incorporated herein by reference.

EXAMPLES

The following examples illustrate specific and exemplary embodiments and/or features of the embodiments of the present disclosure. The examples are provided solely for the purposes of illustration and should not be construed as limitations of the present disclosure. Numerous variations over these specific examples are possible without departing from the spirit and scope of the presently disclosed embodiments. More specifically, the particular rubbers, fillers, and other ingredients (e.g., antioxidant, curative, etc.) utilized in the examples should not be interpreted as limiting since other such ingredients consistent with the disclosure in the Detailed Description can utilized in substitution. That is, the particular ingredients in the compositions, as well as their respective amounts and relative amounts should be understood to apply to the more general content of the Detailed Description.

Example 1

Acid Treatment of Kevlar Fibers

Kevlar fibers were obtained from DuPont Co. The obtained fibers were viewed using a Scanning Electron Microscope and an image of the fibers is shown in FIG. 1.

Figure 2:
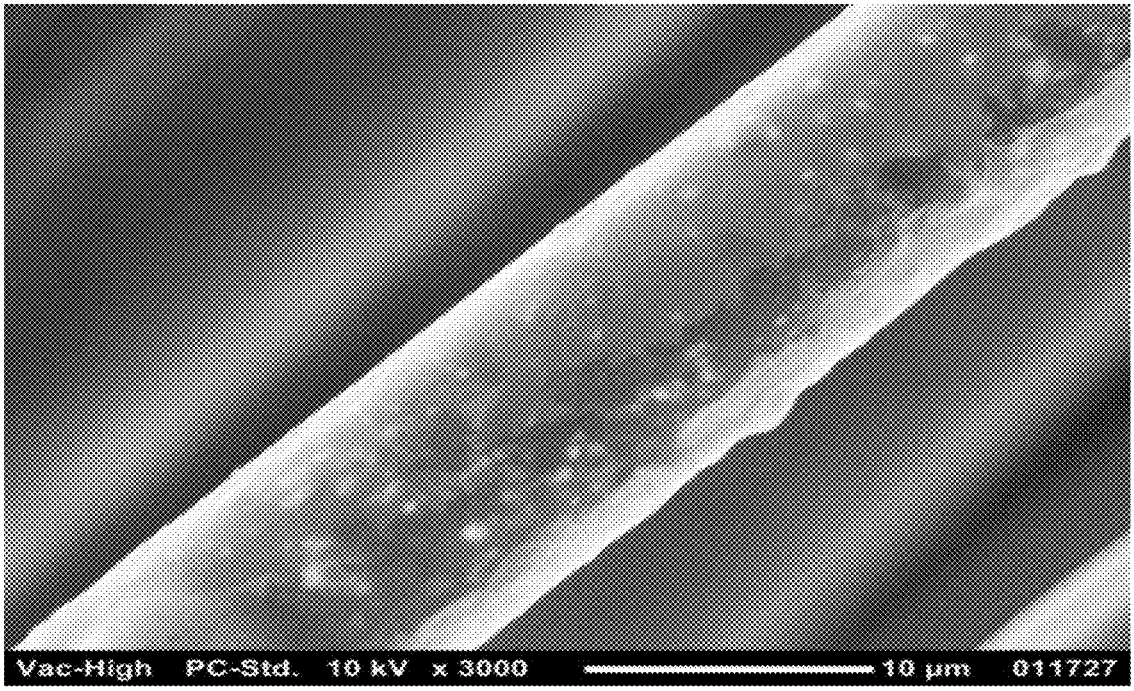
FIG. 2 shows a scanning electron microscope image of poly(paraphenylene terephthalamide) fibers that were immersed in a sulfuric acid solution.
Figure 3:
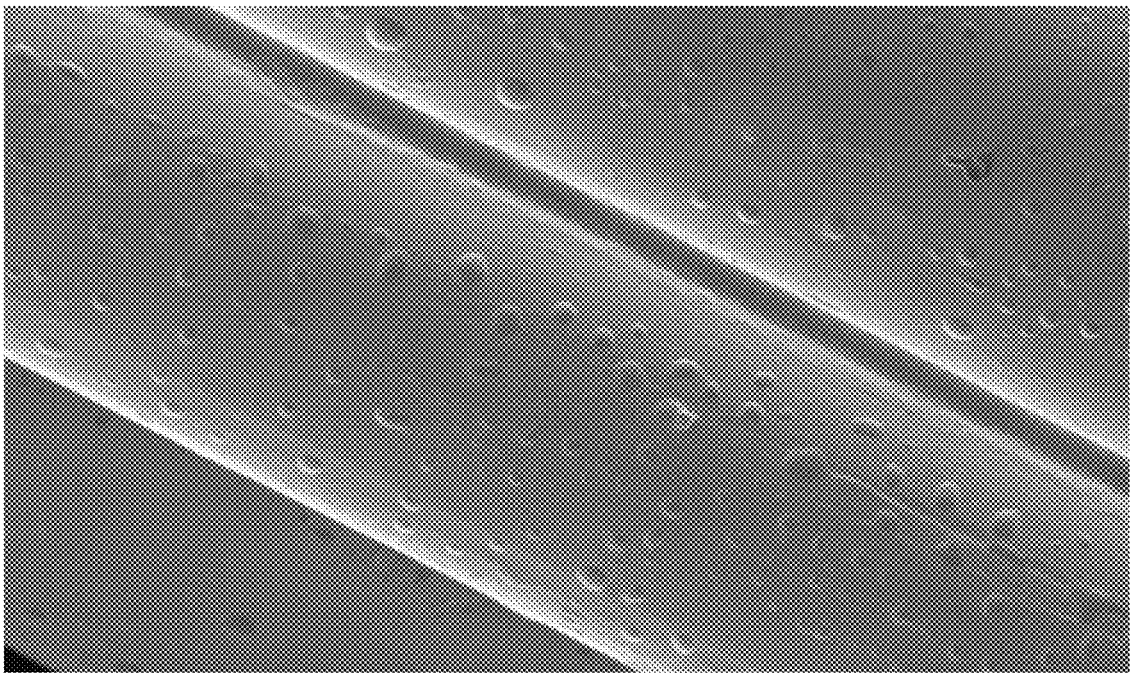
FIG. 3 shows a scanning electron microscope image of poly(paraphenylene terephthalamide) fibers that were immersed in a sulfuric acid solution and then irradiated with microwave energy.

A portion of the Kevlar fibers were soaked in a 12M solution of HCl and the other portion of Kevlar fibers were soaked in a 12M solution of sulfuric acid ($H_2SO_4$) for a period of 24 hours. The soaked fibers were viewed using a Scanning Electron Microscope and images of the HCl— and $H_2SO_4$-soaked fibers are shown in FIGS. 2 and 3, respectively. As shown, the surface of the fibers became modified and exhibited texturing and pitting, which added to the surface roughness of the fibers.

Example 2

Microwave/Acid Treatment of Kevlar Fibers

Figure 4:
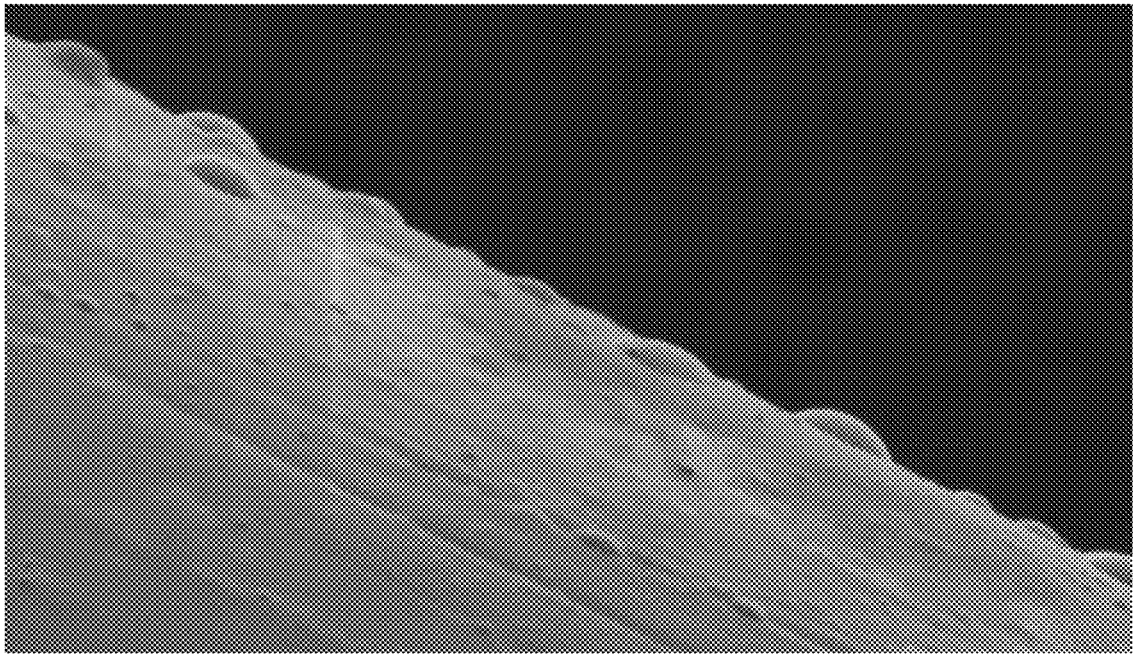
FIG. 4 shows a scanning electron microscope image of poly(paraphenylene terephthalamide) fibers that were immersed in a sulfuric acid solution and then irradiated with microwave energy.

Kevlar fibers obtained from DuPont Co. were soaked in a 50 weight percent sulfuric acid aqueous solution for one hour. The fibers were removed from the sulfuric acid solution and immersed in DI water. The immersed fibers were then subjected to irradiating microwaves at a power of 100 Watts for a period of 2 minutes. The fibers were removed from the water and dried. The dried fibers were viewed using a Scanning Electron Microscope are images of the fibers are shown in FIGS. 3 and 4. As shown, the surface of the fibers became modified and exhibited a blister morphology, which may have been the result of residual acid in the voids or porous surface of the fibers being subjected to microwave energy and trying to exit through the fiber surface.

Example 3

Mechanical Treatment of Kevlar Fibers

Figure 6:
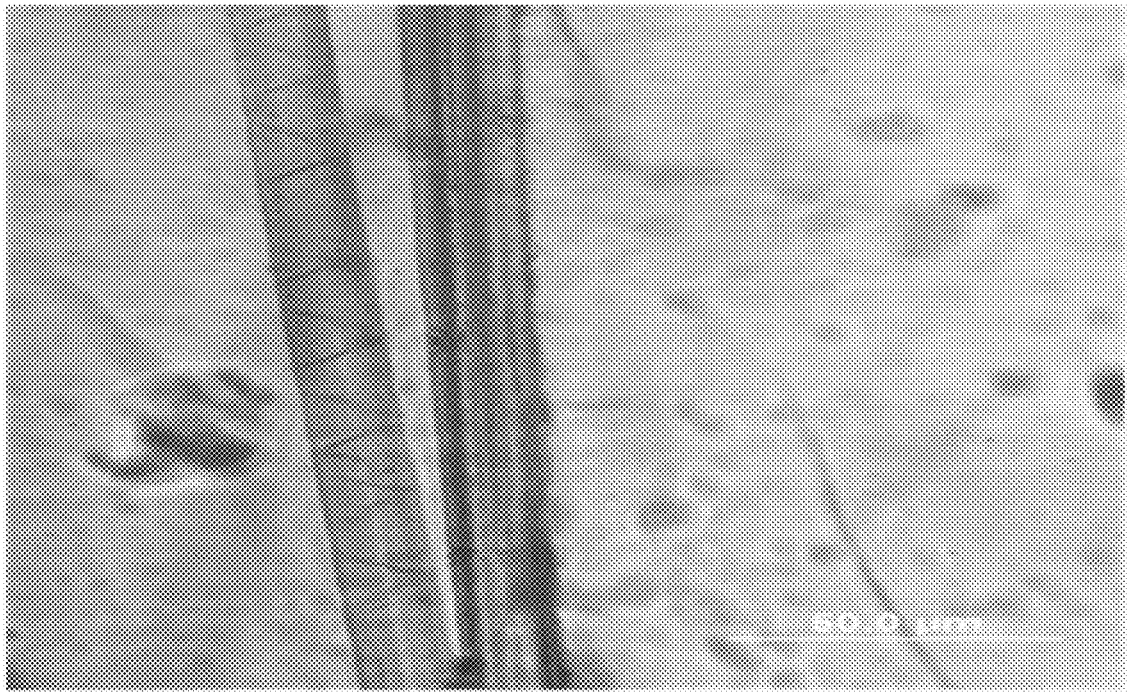
FIG. 6 shows an optical microscope image of poly(paraphenylene terephthalamide) fibers that, were passed through the device shown in FIG. 6.

Kevlar fibers obtained from DuPont Co. were passed over curvatures of 2 mm in diameter at a rate of 500 mm/min using an Instron tensile testing machine with a load of 1 N. The device used to impose a uniform and consistent amount of compression and bending strain on the fibers is shown in FIG. 5. The fibers were bent around the curvatures at an angle of 120 degrees. The mechanically treated fibers were the embedded in clear polystyrene matrix and observed under an optical microscope. An image of the mechanically treated fibers is shown in FIG. 6.

The fibers exhibited "V" shaped notches or kink bands, which suggests a buckling of the surface of the fibers. The test performed on the fibers shows that the fibers deform in a non-Hookean manner at low bending strains, which suggests that the deformation is plastic in nature. The modified surface of the fibers show that mechanical treatment of the fibers to impart bending strains is an efficient and effective method for introducing roughness to the surface of the fibers.

Example 4

Adhesion Tests of Untreated and Treated Fibers

Kevlar fibers obtained from DuPont Co. were separated into batches for testing adhesion to a rubber composition. The rubber composition used is shown below in Table 1.

TABLE 1

Rubber Composition

| | Formula | Rubber Composition (phr) |
|---|---|---|
| Master | Natural Rubber (NR) | 100 |
| | Carbon Black | 65 |
| | Naphthenic Oil | 10 |
| | Stearic Acid | 1.3 |
| | Zinc Oxide | 5 |
| Final | Sulfur | 1.2 |
| | N-t-buthylbenzothiazole-2-sulfenamide (TBBS) | 0.8 |
| | 2,2'-dithiobisbenzothiazole (MBTS) | 1.3 |

The first portion of the fibers was tested without treating the fibers before adhesion to the rubber composition (i.e. "untreated"). A second portion of the fibers was immersed in divinyl benzene and a third portion of the fibers was immersed in low molecular weight silicone having a molecular weight ($M_W$) of about 345 grams per mole. The second and third portions of fibers were immersed at 25° C. for 1 hour. A fourth and fifth portion of the fibers were respectively immersed in divinyl benzene and vinyl-substituted low molecular weight silicone having a molecular weight ($M_W$) of about 345 grams per mole in the presence of supercritical carbon dioxide in a high pressure vessel at a pressure of 5,000 psi and a temperature of 50° C. for 1 hour.

Adhesion specimens were prepared and tested for the five sets of fibers. As described below, herein the adhesion test is referred to as TEST #1, which was used for measuring and generating adhesion data in the Examples below. The adhesion tests were performed using an Instron Tensile testing machine. A fixed amount of twist of 150 turns per meter was applied to the fibers after treatments and then the fibers were placed between two strips of the rubber composition shown in Table 1 above. Studies have shown that twisting the fiber has the effect of projecting a uniform and constant surface area to the matrix, which can reduce the scatter in adhesion data. A schematic of the specimen preparation for the adhesion test is shown in FIG. 7 and a shear lag model for an adhesion test to measure the adhesion of fibers to a rubber matrix is shown in FIG. 8.

Figure 9:
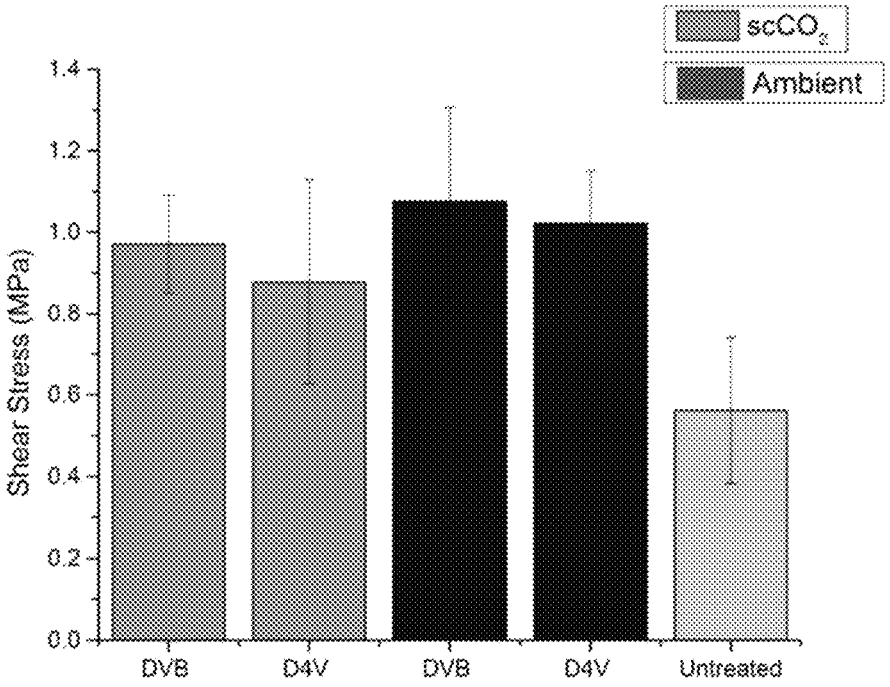
FIG. 9 is a graph showing measured adhesion of aramid fibers to a rubber composition according to TEST #1.

The measured adhesion results of the untreated and treated fibers (5 sets) are shown in FIG. 9. The fibers soaked in divinyl benzene and low molecular weight silicone exhibited higher adhesion to the rubber composition as compared to the untreated fibers. The fibers soaked in divinyl benzene at ambient conditions exhibited an adhesion of greater than 1 MPa and about 1.1 MPa. The fibers soaked in low molecular weight silicone at ambient conditions exhibited an adhesion of greater than 1 MPa and about 1.03 MPa. The fibers soaked in divinyl benzene in the presence of supercritical carbon dioxide exhibited an adhesion of greater than 0.9 MPa and about 0.97 MPa. The fibers soaked in low molecular weight silicone in the presence of supercritical carbon dioxide exhibited an adhesion of greater than 0.8 MPa and about 0.87 MPa. As shown, all of the treated fibers exhibited an adhesion of greater than 0.8 MPa and 0.85 MPa, which is a substantial improvement as compared to the adhesion results of the untreated fibers that exhibited an adhesion of about 0.57 MPa.

Example 5

Adhesion Tests of Untreated and Treated Fibers

Kevlar fibers obtained from DuPont Co. were separated into batches for testing adhesion to a rubber composition as shown in Example 4 above.

The first portion of the fibers was tested without treating the fibers before adhesion to the rubber composition (i.e. "untreated"). The second portion of the fibers was immersed in a 50 weight percent sulfuric acid aqueous solution for one hour, removed from the acid solution and immersed in divinyl benzene in the presence of supercritical carbon dioxide in a high pressure vessel at a pressure of 5,000 psi and a temperature of 50° C. for 1 hour. The third portion of the fibers was not subjected to acid treatment but was immersed in divinyl benzene in the presence of supercritical carbon dioxide in a high pressure vessel at a pressure of 5,000 psi and a temperature of 50° C. for 1 hour.

Figure 10:
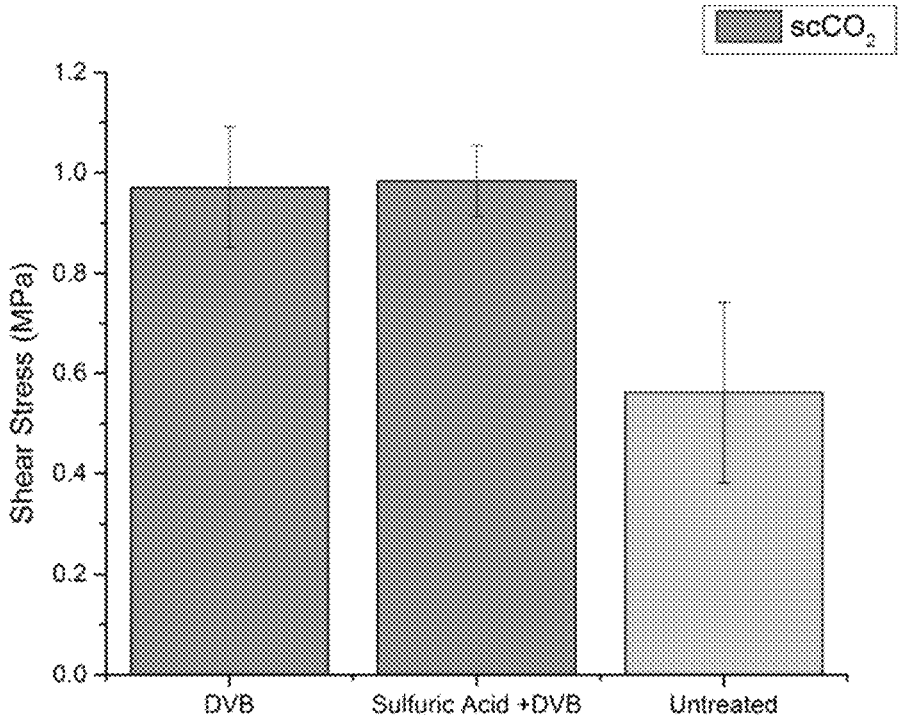
FIG. 10 is a graph showing measured adhesion of aramid fibers to a rubber composition according to TEST #1.

The measured adhesion results of the untreated and treated fibers (3 sets) are shown in FIG. 10. The fibers immersed in sulfuric acid and then soaked in divinyl benzene in the presence of supercritical carbon dioxide exhibited an adhesion of greater than 0.9 MPa and about 0.99 MPa. The fibers that were not subjected to an acid treatment but were soaked in divinyl benzene in the presence of supercritical carbon dioxide exhibited an adhesion of greater than 0.9 MPa and about 0.97 MPa. As shown, all of the treated fibers exhibited an adhesion of greater than 0.9 MPa and 0.95 MPa, which is a substantial improvement as compared to the adhesion results of the untreated fibers that exhibited an adhesion of about 0.57 MPa.

Example 6

Adhesion Tests of Untreated and Treated Fibers

Kevlar fibers obtained from DuPont Co. were separated into batches for testing adhesion to a rubber composition as shown in Example 4 above.

The first portion of the fibers was tested without treating the fibers before adhesion to the rubber composition (i.e. "untreated"). The second portion of the fibers was immersed in a 50 weight percent sulfuric acid aqueous solution for one hour, removed from the acid solution and dried. The immersed fibers were then subjected to irradiating microwaves at a power of 100 Watts for a period of 2 minutes. The fibers were removed from the water and immersed in divinyl benzene at 25° C. for 1 hour. The third portion of the fibers was treated the same as the second portion except that low molecular weight silicone having a molecular weight ($M_W$) of about 345 grams per mole was used in place of divinyl benzene. The fourth portion of the fibers was treated the same as the second portion except that divinyl benzene in the presence of supercritical carbon dioxide in a high pressure vessel at a pressure of 5,000 psi and a temperature of 50° C. for 1 hour was used to apply the coupling agent. The fifth portion of the fibers was treated the same as the fourth portion except that low molecular weight silicone having a molecular weight ($M_W$) of about 345 grams per mole was used in place of divinyl benzene.

Figure 11:
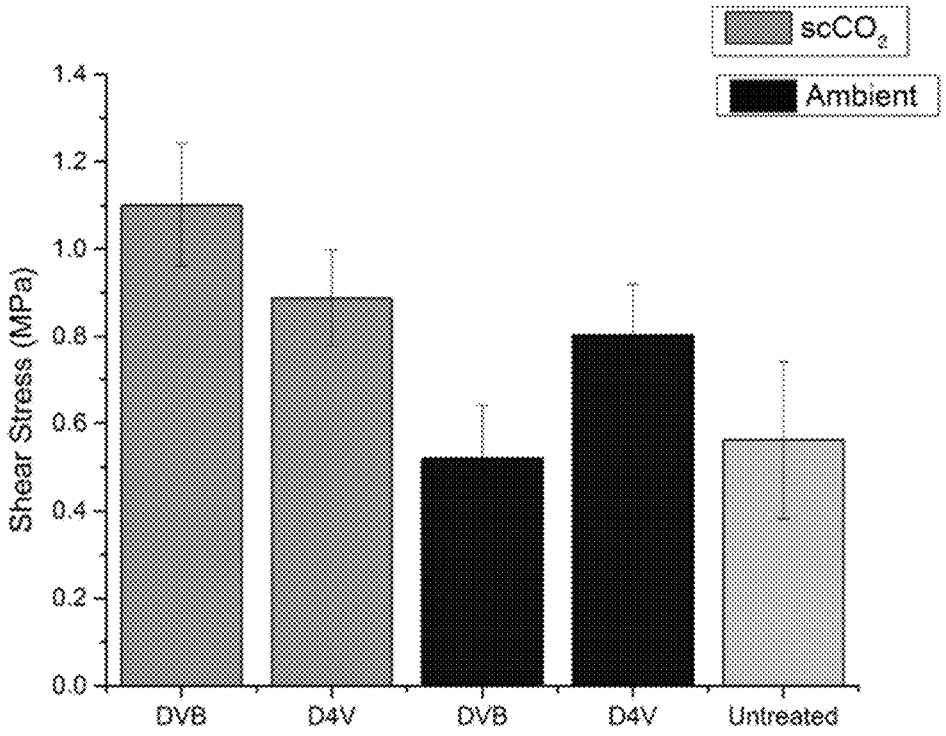
FIG. 11 is a graph showing measured adhesion of aramid fibers to a rubber composition according to TEST #1.

The measured adhesion results of the untreated and treated fibers (5 sets) are shown in FIG. 11. The second portion of fibers exhibited an adhesion of greater than 0.5 MPa and about 0.53 MPa, the third portion exhibited an adhesion of greater than 0.8 and about 0.81 MPa, the fourth portion exhibited an adhesion of greater than 1.05 and about 1.1 MPa and the fifth portion exhibited an adhesion of greater than 0.8 and about 0.89 MPa. As shown, the presence of supercritical carbon dioxide improved the adhesion results as compared to the fibers that were soaked with a coupling agent at ambient conditions. It is believed that the blister morphology on the surface of the fibers may be caused due to residual acids trying to escape from the sub surface voids of the fibers. This surface morphology may have led to the sub surface being more accessible to the supercritical carbon dioxide.

Example 7

Adhesion Tests of Untreated and Treated Fibers

Kevlar fibers obtained from DuPont Co. were separated into batches for testing adhesion to a rubber composition as shown in Example 4 above.

The first portion of the fibers was tested without treating the fibers before adhesion to the rubber composition (i.e. "untreated"). The second portion of the fibers was subjected to a mechanical treatment as described in Example 3, and then the fibers were immersed in divinyl benzene in the presence of supercritical carbon dioxide in a high pressure vessel at a pressure of 5,000 psi and a temperature of 50° C. for 1 hour. The third portion of the fibers was subjected to a mechanical treatment as described in Example 3, and then the fibers were immersed in low molecular weight silicone having a molecular weight ($M_W$) of about 345 grams per mole in the presence of supercritical carbon dioxide in a high pressure vessel at a pressure of 5,000 psi and a temperature of 50° C. for 1 hour.

Figure 12:
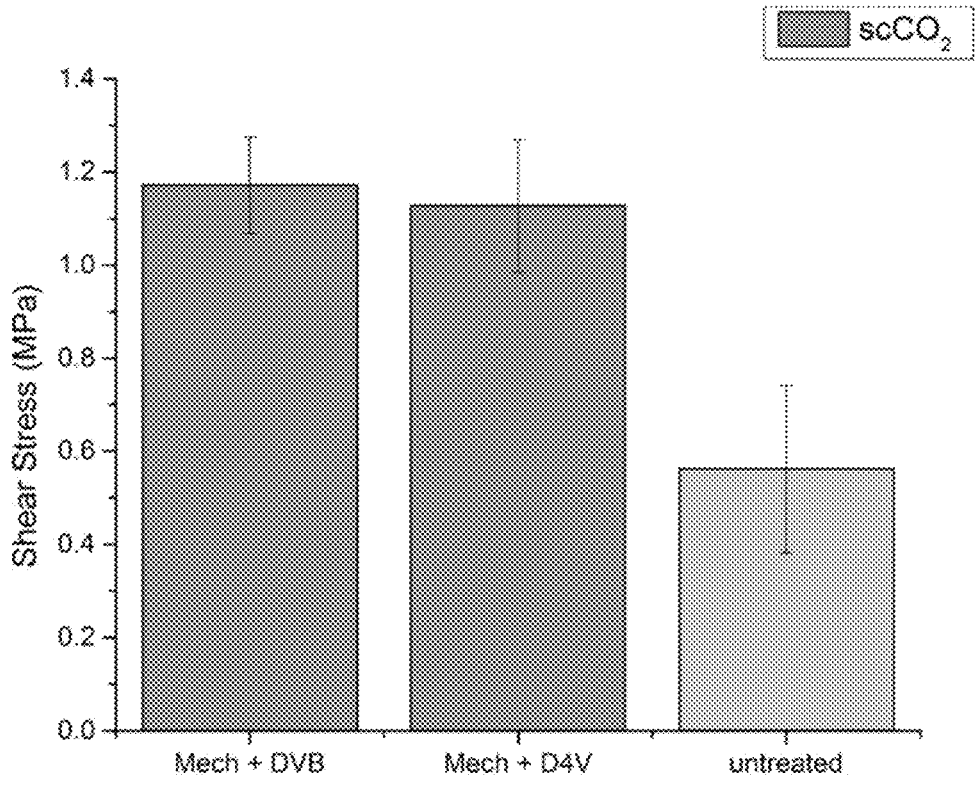
FIG. 12 is a graph showing measured adhesion of aramid fibers to a rubber composition according to TEST #1.

The measured adhesion results of the untreated and treated fibers (3 sets) are shown in FIG. 12. The second portion of the fiber that were mechanically treated and immersed in divinyl benzene exhibited an adhesion of greater than 1.15 and about 1.17 MPa. The third portion of the fiber that were mechanically treated and immersed in low molecular weight silicone exhibited an adhesion of greater than 1.1 and about 1.15 MPa. As shown, all of the treated fibers exhibited an adhesion of greater than 1 MPa and 1.1 MPa, which is a substantial improvement as compared to the adhesion results of the untreated fibers that exhibited an adhesion of about 0.57 MPa.

All references, including but not limited to patents, patent applications, and non-patent literature are hereby incorporated by reference herein in their entirety.

While various aspects and embodiments of the compositions and methods have been disclosed herein, other aspects and embodiments will be apparent to those skilled in the art. The various aspects and embodiments disclosed herein are for purposes of illustration and are not intended to be limiting, with the true scope and spirit being indicated by the claims.

The invention claimed is:

1. A method for modifying the surface of an aramid fiber, the method comprising: a. subjecting the aramid fiber to a constant tensile force in the range of 0.5 N to 3 N; b. bending the aramid fiber two or more times at an angle of greater than 90 degrees to form notches on the surface of the aramid fiber; c. releasing the aramid fiber from the tensile force; and d. the aramid fiber being twisted at a twist rate of in the range of 10 to 200 turns per meter after step (c).

2. The method of claim 1, the aramid fiber being poly (paraphenylene terephthalamide).

3. The method of claim 1, the aramid fiber being poly (metaphenylene isophthalamide).

4. The method of claim 1, the constant tensile force applied to the aramid fiber of step (a) being continuous and in the range of 0.5 N to 2 N.

5. The method of claim 1, step (b) comprising bending the aramid fiber three or more times.

6. The method of claim 1, step (b) comprising bending the aramid fiber two or more times at an angle of at least 100 degrees.

7. The method of claim 1, step (b) comprising bending the aramid fiber two or more times at an angle of at least 110 degrees.

8. The method of claim 1, step (b) being carried out in a continuous process by passing the aramid fiber over an element to apply the bending of the aramid fiber.

9. The method of claim 8, the element being a roller or a static cylinder having a curved surface.

10. The method of claim 1, further comprising contacting the aramid fiber of step (c) with a coupling agent.

11. The method of claim 10, the coupling agent being a vinyl-substituted compound.

12. The method of claim 11, the vinyl-substituted compound being a cyclic compound having two or more vinyl groups.

13. The method of claim 10, the coupling agent being a vinyl-substituted low molecular weight silicone having a molecular weight ($M_w$) of less than 1000 or a combination thereof.

14. The method of claim 10, the coupling agent being a cyclic compound having a branched alkyl substituent.

15. The method of claim 10, the coupling agent being mixed with a solvent.

16. The method of claim 15, the solvent being an organic solvent.

17. The method of claim 15, the solvent being supercritical carbon dioxide.

18. The method of claim 10, the aramid fiber of step (c) being immersed in a coupling agent fluid for at least 30 minutes.

19. The method of claim 18, the aramid fiber having an adhesion greater than 0.8 MPa to a rubber composition, according to TEST #1.

20. A method for modifying the surface of an aramid fiber, the method comprising:

a. subjecting the aramid fiber to a constant tensile force in the range of 0.5 N to less than 2 N;
b. bending the aramid fiber two or more times at an angle of greater than 90 degrees to form notches on the surface of the aramid fiber;
c. releasing the aramid fiber from the tensile force; and
d. the aramid fiber being twisted at a twist rate of in the range of 10 to 200 turns per meter after step (c).

* * * * *